US005378062A

United States Patent [19]

Rains

[11] Patent Number: 5,378,062

[45] Date of Patent: Jan. 3, 1995

[54] TRANSFER ASSEMBLY FOR DISASSEMBLY DEVICE

[75] Inventor: Robert L. Rains, Oxnard, Calif.

[73] Assignee: General Signal Corporation, Stamford, Conn.

[21] Appl. No.: 21,026

[22] Filed: Feb. 23, 1993

[51] Int. Cl.[6] ..... B01F 13/08

[52] U.S. Cl. ..... 366/273; 366/274; 366/314; 403/DIG. 1; 464/29

[58] Field of Search ..... 366/273, 274, 205, 197, 366/199, 314, 331; 464/29; 403/DIG. 1

[56] References Cited

U.S. PATENT DOCUMENTS

| | | | |
|---|---|---|---|
| 2,437,871 | 3/1948 | Wood | 464/29 X |
| 3,304,990 | 2/1967 | Ontko et al. | 366/273 X |
| 3,542,178 | 11/1970 | Ripple | 366/205 X |
| 3,572,651 | 4/1971 | Harker | 366/273 X |
| 3,596,692 | 8/1971 | Swanke | 366/205 X |
| 3,694,341 | 9/1972 | Luck, Jr. | 366/273 |
| 4,162,855 | 7/1979 | Bender | 366/274 |
| 4,577,975 | 3/1986 | McCrory et al. | 366/314 |
| 4,653,519 | 3/1987 | Kanner | 366/273 X |
| 4,993,841 | 2/1991 | Lofgren et al. | 366/274 |

FOREIGN PATENT DOCUMENTS

| | | | |
|---|---|---|---|
| 622115 | 3/1949 | United Kingdom | 366/274 |

*Primary Examiner*—Timothy F. Simone
*Assistant Examiner*—Patrick F. Brinson
*Attorney, Agent, or Firm*—Blakely, Sokoloff, Taylor, Zafman

[57] ABSTRACT

A transporter which allows a single motor/magnetic coupler assembly to be coupled to one of a plurality of agitator tanks. The transporter includes an arm which is pivotally connected to a frame. The arm supports a motor and an outer magnetic mixer assembly that can be coupled to an inner magnetic mixer assembly located within the inner cavity of an agitator tank. The arm is adapted so that an operator can move the outer magnetic mixer assembly between a first position and a second position. The outer assembly is coupled to the inner assembly when in the second position and decoupled from the inner assembly when in the first position. The transporter has wheels so that the operator can move the outer assembly and motor from one agitator tank to another agitator tank.

6 Claims, 2 Drawing Sheets

TRANSFER ASSEMBLY FOR DISASSEMBLY DEVICE

BACKGROUND OF THE INVENTION

1. FIELD OF THE INVENTION

The present invention relates to an agitator tank that has a magnetic coupled mixer.

2. DESCRIPTION OF RELATED ART

Chemical compounds are typically mixed within an agitator tank that contains a rotating mixer. The mixer includes an impeller that extends from a motor located exterior to the tank. To reduce the amount of sealing required around the motor and impeller some agitator tanks employ magnetic couplers. Magnetic couplers typically have a drive magnet that is attached to a motor and a driven magnet connected to the impeller. The magnets couple the impeller to the motor, so that the impeller can be rotated without having a direct mechanical link between the two members.

Some tank batches require only periodic mixing to combine the ingredients of the tank. For example, when formulating pharmaceutical products it is sometimes necessary to mix the compounds only a few minutes every 20–30 minutes. The products are typically mixed in a plurality of tanks which each contain a separate mixer/motor assembly. Having to purchase and maintain a plurality of magnetic coupled motor assemblies can be prohibitively expensive. It would therefore be desirable to have a multiple agitator tank system which would allow one motor to operate all of the tanks.

SUMMARY OF THE INVENTION

The present invention is a transporter which allows a single motor/magnetic coupler assembly to be coupled to one of a plurality of agitator tanks. The transporter includes an arm which is pivotally connected to a frame. The arm supports a motor and an outer magnetic mixer assembly that can be coupled to an inner magnetic mixer assembly located within the inner cavity of an agitator tank. The arm is adapted so that an operator can move the outer magnetic mixer assembly between a first position and a second position. The outer assembly is coupled to the inner assembly when in the second position and decoupled from the inner assembly when in the first position. The transporter has wheels so that the operator can move the outer assembly and motor from one agitator tank to another agitator tank.

In operation, the transporter is moved adjacent to an agitator tank and the outer mixer assembly is rotated into operative engagement with the inner mixer assembly. The motor is then activated to induce rotation of the impeller within the tank. After a predetermined time interval, the motor is stopped and the outer mixer assembly is rotated away from the inner assembly. The transporter is then moved to a different agitator tank and the outer mixer assembly is coupled to the inner mixer assembly of the tank.

Therefore it is an object of the present invention to provide a system that allows one motor/magnetic coupler assembly to operate a plurality of agitator tanks.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
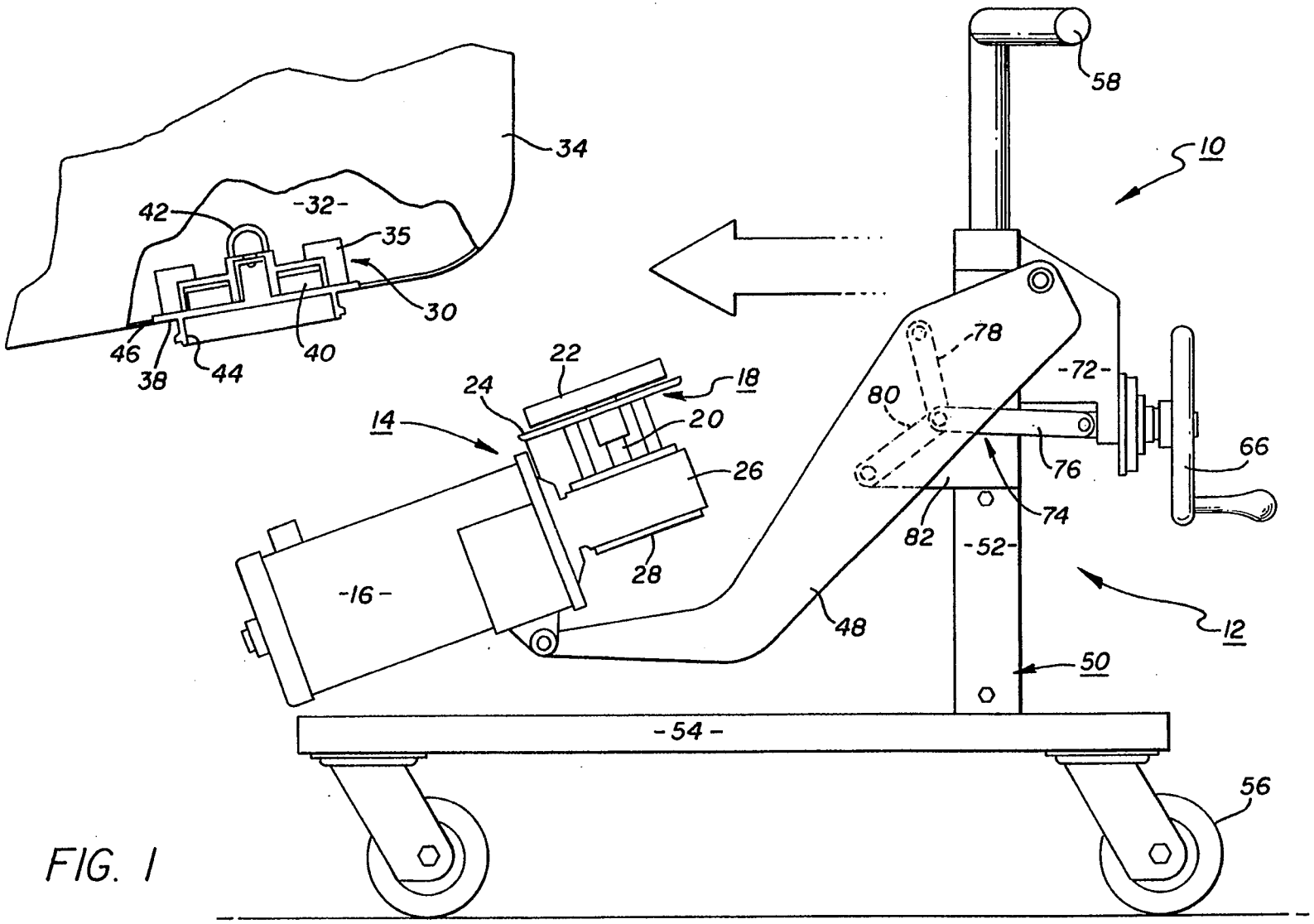
FIG. 1 is a side view of a system of the present invention showing a motor/magnetic coupler located in a decoupled position.

Referring to the drawings more particularly by reference numbers, FIG. 1 shows a transporter system 10 of the present invention. The transporter system 10 includes a transporter 12 which supports a motor/magnetic mixer assembly 14. The motor mixer assembly 14 includes a motor 16 and an outer magnetic mixer assembly 18.

The motor 16 has an output shaft 20 which is connected to a drive magnet 22 that extends from an outer mixer frame 24. The outer mixer frame 24 is captured by a collar 26 which extends from the motor 16. The output shaft 20 shown is typically coupled to another output shaft (not shown) that extends from the motor and is perpendicular to the shaft 20. The shaft 20 and the output shaft of the motor 16 are coupled by a gear box 28 which translates rotation of the motor shaft into rotation of the output shaft 20. Rotation of the Output shaft 20 rotates the drive magnet 22 accordingly.

The outer magnetic mixer assembly 18 is adapted to be coupled to an inner magnetic mixer assembly 30 located within an inner cavity 32 of an agitator tank 34. The inner mixer assembly 30 has an impeller 36 that can rotate relative to an inner mixer frame 38. The inner mixer assembly 30 also contains a driven magnet 40 which rotates the impeller 36. Extending from the top of the impeller 36 is a handle 42 which allows the operator to place the inner assembly 30 into the tank 34. The inner mixer frame 38 has an annular sleeve receptacle 44 that extends through an opening 40 in the tank 34. The sleeve 44 is adapted to receive the drive magnet 22 of the outer magnetic mixer assembly 18 and align the drive magnet 22 with the driven magnet 40.

The motor/magnetic mixer assembly 14 is supported by an arm 48 that is pivotally connected to a frame 50. The frame 50 has a support beam 52 that is mounted to a baseplate 54. Attached to the baseplate 54 are a plurality of wheels 56. The frame 50 may also have a handle 58 which allows an operator to move the transporter 12 from one location to another location.

Figure 2:
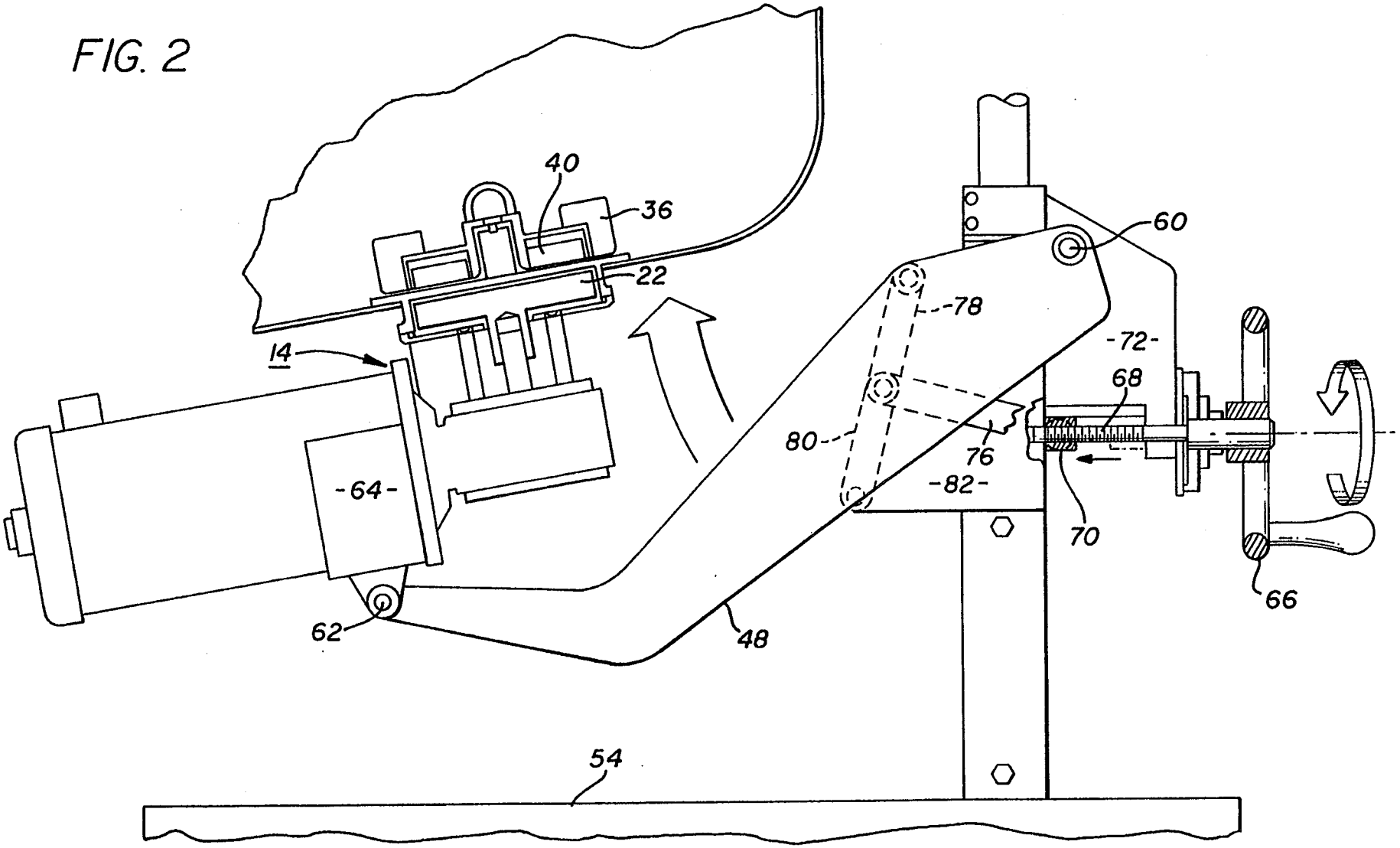
FIG. 2 is a side view showing the motor/magnetic coupler in a second position.

As shown in FIG. 2, the arm 48 is adapted to be rotated and to move the motor/magnetic mixer assembly 14 between a first position and a second position shown in FIG. 2. When the assembly 14 is in the second position, the drive magnet 22 is magnetically coupled to the driven magnet 40. When the assembly is in the second position, rotation of drive magnet 22 will induce rotation of the driven magnet 40 and the accompanying impeller 36.

The arm 48 may pivot about a first pin 60. The arm 48 may also have a second pin 62 which allows the motor/-magnetic mixer assembly 14 to rotate relative to the arm 48. The motor/assembly 14 may be coupled to the second pin 62 by a housing 64 which supports the motor 16. The second pin 62 allows the outer mixer assembly 18 to pivot, so that the drive magnet 22 is coaxial with the driven magnet 40 when rotated into the second position.

The transporter 12 preferably contains a device or mechanism which provides a mechanical advantage in rotating the arm 48, so that an operator can move the motor/magnetic mixer assembly 14 with relatively little effort. As shown in FIGS. 1 and 2, the transporter 12 may have a wheel 66 that can be rotated by the operator. The wheel 66 has a shaft 68 that extends through a threaded aperture 70 in a frame bracket 72. The wheel shaft 68 is coupled to a linkage mechanism 74 which includes a push rod 76 pivotally connected to the shaft 68, the arm 48 and a pair of secondary rods 78 and 80. The first secondary rod 78 is pivotally connected to the arm 48. The second secondary arm 80 is pivotally connected to bracket 82. Rotation of the wheel 66 moves the push rod 76, which rotates the arm 48 and mixer assembly 14. As shown in FIG. 2, the secondary arms 78 and 80 are moved into an over-center position to lock the arm 48 and mixer assembly 14 into the second position. Although a threaded shaft/wheel arrangement is shown and described, it is to be understood that the present invention may employ other arm rotation means such as an electric, or hydraulic motor.

In operation, the transporter 12 is moved so that the motor/magnetic mixer assembly 14 is in the first position shown in FIG. 1. As shown in FIG. 2, the arm 48 is then rotated so that the drive magnet 22 is coupled to the driven magnet 40. The motor 16 is then activated so that the impeller 36 is rotated within the tank 34. After a predetermined time interval, the motor 16 can be stopped and the arm 48 rotated to move the outer magnetic mixer assembly 18 back into the first position. The transporter 12 can then be moved to another tank, where the process is repeated. The present invention thus allows a single motor/magnetic mixer assembly to operate a plurality of agitator tanks. The transporter system is particularly useful in mixing pharmaceuticals which require periodic mixing. Each tank can be synchronized so that one motor/mixer assembly can sequentially mix a plurality of agitator tanks.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus for coupling an outer magnetic assembly to any one of a plurality of inner magnetic assemblies, each one of said plurality of inner magnetic assemblies located within one of a plurality of tanks, and for coupling the outer magnetic assembly to another one of said plurality of inner magnetic assemblies located within another one of a plurality of tanks, comprising:

coupling means for moving the outer magnetic assembly rotationally so that the outer magnetic assembly is coupled to an inner magnetic assembly of a first tank; and transportation means for moving the outer magnetic assembly and said coupling means from the first tank to a second tank that has a second inner magnetic assembly with the outer magnetic assembly positioned to be coupled to the second inner magnetic assembly by the coupling means.

2. The apparatus as recited in claim 1, wherein said coupling means includes an arm pivotally connected to a frame, said arm being attached to the outer magnetic assembly to support the outer magnetic assembly and move the outer magnetic assembly rotationally along at least one axis between a first position and a second position, wherein the outer magnetic assembly is decoupled from the inner magnetic assembly when in said first position, coupled to the inner magnetic assembly when in said second position, and aligned to the inner magnetic assembly using a receptacle on the first tank.

3. The apparatus as recited in claim 1, wherein said transportation means includes a plurality of wheels so that the outer magnetic assembly can be easily wheeled from the first tank to the second tank.

4. An agitator tank system, comprising:

a tank having an inner cavity and a receptacle;

an inner magnetic mixer assembly located within said inner cavity having an impeller which rotates relative to said tank;

an outer magnetic mixer assembly which rotates said impeller;

a motor operatively connected to said outer magnetic mixer assembly;

coupling means for moving said outer magnetic mixer assembly and said motor such that said outer magnetic mixer assembly is coupled to said inner magnetic mixer assembly; and transportation means for moving said outer magnetic mixer assembly, said coupling means, and said motor from said tank to a second tank with said outer magnetic mixer assembly positioned to be coupled to a second inner mixer magnetic assembly of said second tank by said coupling means.

5. The apparatus as recited in claim 4, wherein said coupling means includes an arm pivotally connected to a frame, said arm being attached to said outer magnetic mixer assembly to support said outer magnetic assembly and move said outer magnetic mixer assembly rotationally about at least one pivot point between a first position and a second position, wherein said outer magnetic mixer assembly is decoupled from said inner magnetic mixer assembly when in said first position and coupled to said inner magnetic mixer assembly when in said second position.

6. The apparatus as recited in claim 4, wherein said transportation means includes a plurality of wheels so that the outer magnetic mixer assembly can be easily wheeled from said tank to the second tank.

* * * * *